US005712650A

United States Patent [19]

Barlow

[11] Patent Number: 5,712,650

[45] Date of Patent: Jan. 27, 1998

[54] LARGE INCANDESCENT LIVE IMAGE DISPLAY SYSTEM

[75] Inventor: James E. Barlow, Las Vegas, Nev.

[73] Assignee: Mikohn Gaming Corporation, Las Vegas, Nev.

[21] Appl. No.: 516,882

[22] Filed: Aug. 18, 1995

[51] Int. Cl.[6] ..... G09G 3/20

[52] U.S. Cl. ..... 345/55; 345/73

[58] Field of Search ..... 362/231; 345/32, 345/55, 56, 150, 83, 73, 84, 77, 63, 204; 340/815.65, 815.66, 815.67

[56] References Cited

U.S. PATENT DOCUMENTS

| | | | |
|---|---|---|---|
| 3,728,714 | 4/1973 | Kolesar et al. | 345/56 |
| 3,961,365 | 6/1976 | Payne et al. | 345/150 |
| 4,396,869 | 8/1983 | Rosenbaum et al. . | |
| 4,782,336 | 11/1988 | Bailey | 340/752 |
| 4,843,527 | 6/1989 | Britt | 362/231 |
| 5,027,112 | 6/1991 | Ross et al. | 340/792 |
| 5,198,803 | 3/1993 | Shie et al. | 340/782 |
| 5,321,417 | 6/1994 | Voelzke et al. | 345/32 |
| 5,410,328 | 4/1995 | Yoksza et al. | 345/82 |
| 5,420,482 | 5/1995 | Phares | 315/292 |
| 5,561,351 | 10/1996 | Vrionis et al. . | |

*Primary Examiner*—Chanh Nguyen

*Attorney, Agent, or Firm*—Dorr, Carson, Sloan & Birney, P.C.

[57] ABSTRACT

A high speed control is disclosed for delivering delayed phase power to each of four incandescent xenon bulbs. Each of the four incandescent xenon bulbs are oriented behind a colored lens to form a colored pixel. The colored pixel of the present invention is illuminated to a desired color by means of a high speed control operating at NTSC video standard of 30 frames per second. The invention is based upon an AC power source with conventional 60 cycles of AC power.

15 Claims, 7 Drawing Sheets

LARGE INCANDESCENT LIVE IMAGE DISPLAY SYSTEM

BACKGROUND OF THE INVENTION

1. Related Application

This application claims priority to a prior provisional application entitled Large Incandescent Live Image Display System, filed Jun. 22, 1995, Ser. No. 60/000,429, naming James E. Barlow as inventor.

2. Field of the Invention

This invention relates to large visual displays using incandescent bulbs and, more particularly, the present invention relates to large outdoor, low cost, and low maintenance displays using incandescent xenon bulbs exhibiting low energy requirements for displaying live images in vivid colors.

3. Statement of the Problem

A need exists for large outdoor visual displays that can be placed at remote locations such as on a building or a freestanding pylon. The large display must be capable of vivid color representation and have the ability to display images at the full NTSC video standard of 30 frames per second. The cost, the power consumption, and the maintenance of the large display must be kept as low as possible.

Several technologies are presently available for large visual displays. One large display technology capable of live video displays uses miniature cathode ray tubes. Each cathode ray tube is capable of displaying a blend of three colors: blue, green, or red. Such systems are expensive and require a high level of maintenance. An example of such a system is the Sony Jumbotron.

A second type of technology is based on light-emitting diodes (LEDs). U.S. Pat. Nos. 5,198,803 entitled "Large Scale Movie Display System with Multiple Gray Levels" and 5,410,328 entitled "Replaceable Intelligent Pixel Module for Large-Scale LED Displays" provide LED displays capable of displaying television or movie images under computer or processor control. LED displays have a long useful life (more than 10 years), reduced dimensions, and small operating voltages (1.5–2.4 volts) and currents (5–20 milliamps). The '803 patent sets forth an approach using LEDs that is capable of displaying movie, television, or video images at a frame rate of 30 frames per second.

Present visual displays made from incandescent bulbs, however, exhibit high energy consumption. The '803 patent criticizes conventional incandescent bulb display boards as providing a residual image from a preceding image when changed to a new image. The residual image results because the heating time constant of the filament in each incandescent bulb is too long Hence conventional incandescent bulb display systems do not display pictures that change at the NTSC standard of 30 frames per second. The '803 patent also criticizes incandescent bulb systems as requiring greater driving currents and power wherein the current must be controlled by high power elements. Finally such incandescent systems are criticized for requiring time- and labor-consuming maintenance especially in the frequent replacement of incandescent bulbs. A need exists to provide a large display system using incandescent bulbs of low power consumption and long life so as to reduce the cost of operation.

Various prior art incandescent systems are known to exist. U.S. Pat. No. 5,321,417 entitled "Visual Displays Panel" sets forth a light-transmitting visual display panel using incandescent bulbs closely spaced together. In front of each incandescent bulb is a removable and interchangeable rigid light-refracting lens. Each lens has a plurality of narrow, adjacent, horizontal prisms on the outside surface thereof adapted to refract light to an angle below horizontal (to aid in viewing the elevated sign) and a plurality of narrow, adjacent, vertical horizontal beam spread controlling prisms on the inside surface thereof (to aid in eliminating bright spots). Pillow prisms are used in the edges to provide an uniform pixel fill. The '417 patent recognizes that the quantity of blue light in the incandescent spectrum is low, requiring the bulb for the color blue to run at higher energy levels, which increases the heat.

U.S. Pat. No. 4,843,527 entitled "Matrix Lamp Bank Display and Light Filtering Assembly" discloses an incandescent lamp system utilizing colored lenses in front of each lamp. The '527 patent recognizes the problems associated with balancing colors at various intensity levels and the difficulty of using various "levels of intensity." The '527 patent solves the problem of color balancing by varying the thickness of the lens in front of the lamp. For example, the thickness for a blue lens would be less than the thickness for a green lens. The degree of thickness is determined through experimental testing utilizing a particular lamp design. A need exists for an incandescent lamp display wherein each lens is of identical thickness and configuration to minimize manufacturing costs. Furthermore, a need exists to provide an incandescent lamp display system providing numerous levels of intensity. The '527 patent finally teaches that a group of four lamps with red, blue, green, and clear (tinted light blue) lenses mounted in front form a group.

A need, therefore, exists to provide a large display system capable of displaying live images at 30 frames per second so as to display movies, television, and live video. Such a system should be composed of incandescent bulbs that offer greater light intensity than LED-based systems but also contrary to conventional incandescent bulb display systems, offer lower power consumption, longer life, and lower maintenance. Furthermore, such an incandescent bulb system should be capable of displaying images in vivid colors. Such a system should be capable of being operated by a personal computer or microprocessor-based system interconnected through a standard video capture card.

With respect to control systems for displays, U.S. Pat. No. 5,420,482 entitled "Control Lighting System" sets forth a control system that transmits data and clock information to a plurality of light modules wherein each light module includes at least two light elements and a control unit responsive to the data and clock information received from the control system. The data information enables the control system to vary individually the amount of light emitted by each of the light elements in each light module. Each control unit receives one of three different data words. The first two words represent address data and the third word represents the value for the light. For example, the red lamp would be driven by a digital to analog converter and driver. This, in turn is controlled by a red lamp data register. The intensity of the red lamp can be selectively set to a desired level. A need exists to provide a control for a display that operates at high speeds and controls the phase-delayed power delivered to each pixel without the need to address pixels.

4. Solution to the Problem

Under the teachings of the present invention, a low-power xenon lamp large display system is disclosed that is capable of providing at least 65,000 vivid colors in live video presentations and/or in conventional static or animated presentations. The electronics of this system has the capabilities of generating over 16 million color combinations. In the preferred embodiment, the full color range of over 65,000 vivid colors is maintained while at the same time leaving maximum brightness and hue and color balance adjustable. Full color live images can be accepted and displayed from any NTSC or PAL source at the full 30 frames per second. The present invention is not limited in size and, in the preferred embodiment, consists of a plurality of modules each containing an array of 64 xenon bulbs in 16 pixels.

SUMMARY OF THE INVENTION

A high-speed control is disclosed for delivering delayed phase power to each of four incandescent xenon bulbs. Each of the four incandescent xenon bulbs is oriented behind a colored lens to form a colored pixel. The colored pixel of the present invention is illuminated to a desired color by means of a high-speed control operating at the NTSC video standard of 30 frames per second. The invention is based on an AC power source with conventional 60 cycles of AC power. An AC phase controlled switch is connected to each of the incandescent bulbs and to the AC power source. Each control includes a TRIAC, an up counter connected to the TRIAC and a latch register connected to the counter. A high-speed serial shift register receives power level data at a frequency of at least 6 MHz. When the serial shift register is loaded, the levels are inputted into each register in each of the AC delayed phase controls. The delayed phase power level corresponds to a light intensity for the incandescent bulb. A signal in synchronism with the zero-crossings of the AC power source delivers power level data from the latch register into an up counter during each half cycle. A clock signal also in synchronism with the AC power increments the count in each up counter until the terminal count 255 is reached. A power level data value of 0 corresponds to no intensity for the lamp and 255 corresponds to full intensity. This provides 256 levels of intensity. The terminal count output of each up counter activates its associated TRIAC switch so as to provide the delayed phase power to each of the four incandescent bulbs forming the pixel.

DETAILED DESCRIPTION OF THE INVENTION

1. Pixel Design

Figure 1:
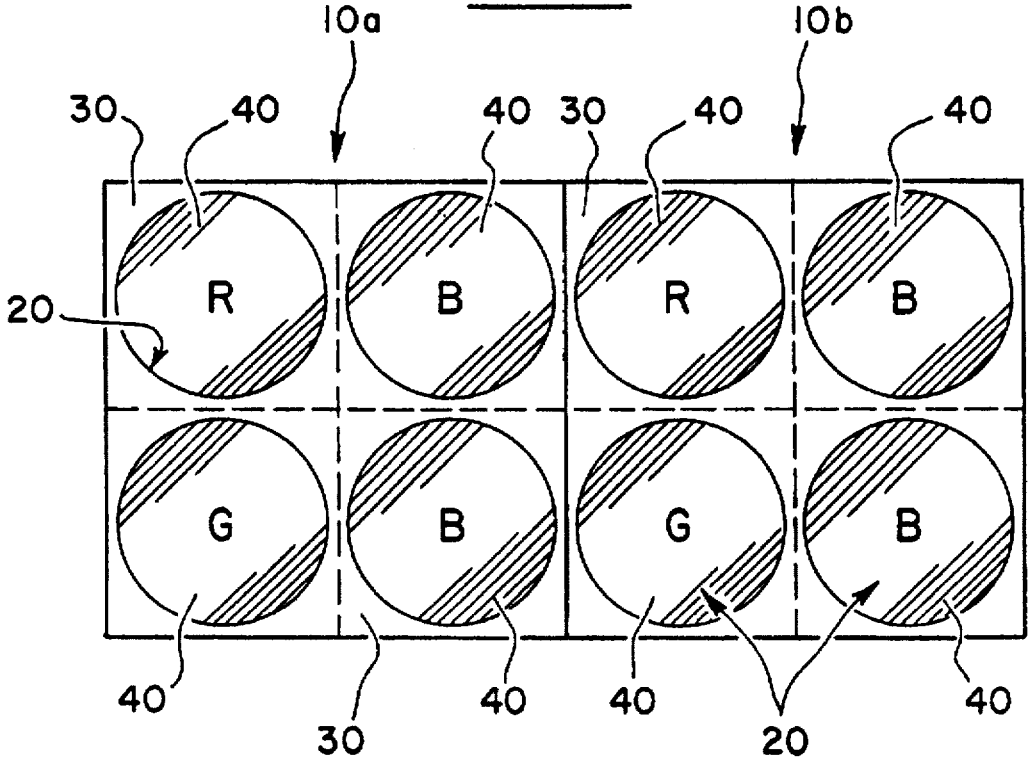
FIG. 1 is an illustration of two pixels showing the red, green, and blue colored lenses.

FIG. 1 illustrated two pixels 10*a* and 10*b* of the present invention. Each pixel 10 has four circular lighted areas 20 set in a darkened opaque background 30. As shown in FIG. 1, and under the teachings of the present invention, each lighted area 20 has a colored lens, not shown, corresponding to the designated colors. Each pixel 10 has two blue (B), one red (R), and one green (G) circular lens. These colors mix together to produce the desired color coming from the pixel 10. Colored lights blend and form new colors through addition of colors. Hence, the color white is created from blue, green, and red. Yellow light, for example, is created from green and red. Unlike conventional displays, which use four colored lenses of white, blue, green, and red, the present invention utilizes two blue lens of the same tint in each pixel 10 without using white. The reason for this is explained next.

The color blue has short wavelengths, green has middle wavelengths, and red has long wavelengths. Incandescent bulbs do not create blue light well. Furthermore, the average person has greater difficulty in perceiving the color blue when compared to the colors red or green, especially outdoors. It is well known that the color blue must have greater intensity in incandescent displays. This is accomplished, under the teachings of the present invention, by providing twice the spatial area 20 in each pixel 10 in comparison to red and green. In conventional four-bulb pixels, the following colors are used: white, blue, red, and green. In outdoor displays, the white color washes out the other colors. Under the teachings of the present invention, the use of two blue spatial areas of the same tint achieves true coloring. The two blues are driven to the same power level (i.e., the same light intensity). Hence, in the configuration of FIG. 1, each color blue, red, and green can have 256 levels of brightness (gray levels) so as to achieve an overall set of color combinations of $256^3$ or 16,777,216 possible color combinations.

Each lens 40 is circular, fitting the spatial area 20, and is of the same design and thickness, contrary to the '527 patent set forth above.

As will be explained later, of the 16 million color possibilities available from the pixel 10 of the present invention, 65,536 are selected to provide a true color representation.

Figure 2:
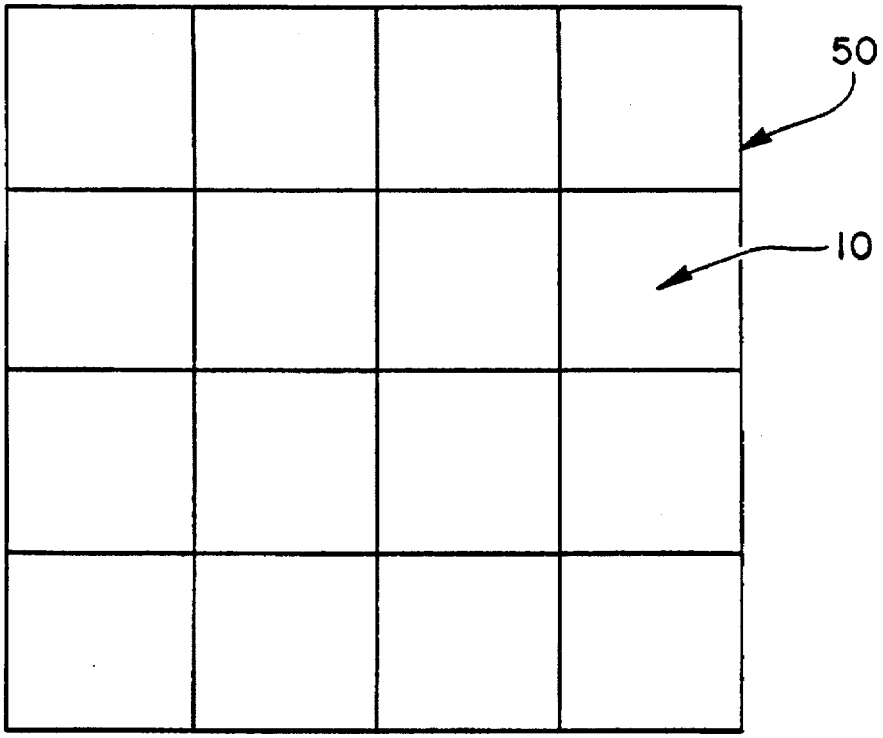
FIG. 2 sets forth a four-by-four pixel module of the present invention.

In FIG. 2 is shown a module 50 comprising sixteen pixels 10. In the preferred embodiment, each pixel is on four-inch centers (vertically and horizontally). In reference to FIG. 1 each spatial area is on two-inch centers. Hence, each module 50 is sixteen inches by sixteen inches. These modules 50 can be interconnected together to form an outdoor display or sign of any desired size.

2. Phase Control

Figure 3:
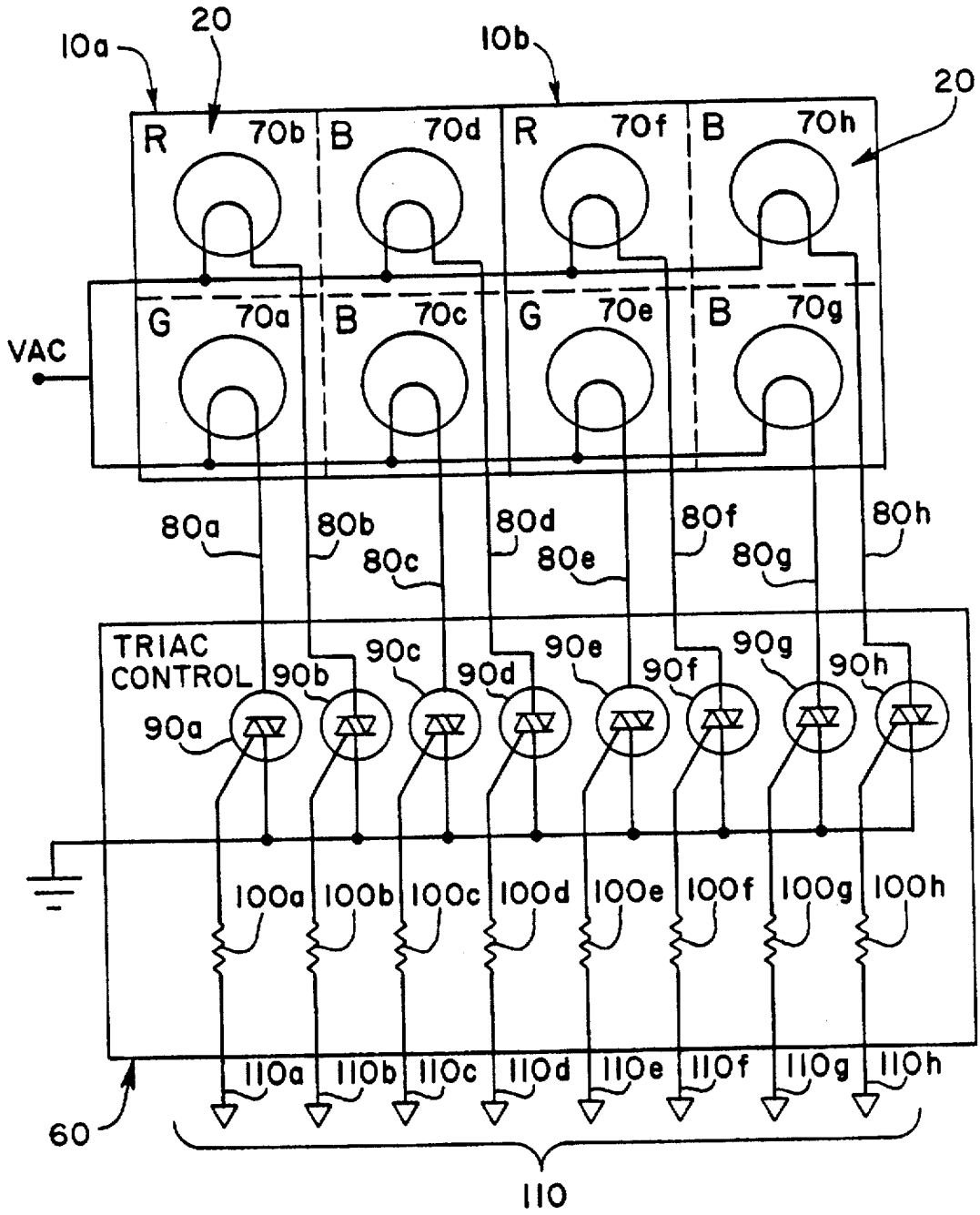
FIG. 3 sets forth the schematic for the control of phase-delayed power delivered to the two-pixel arrangement of FIG. 1.

In FIG. 3, the details of the TRIAC drive 60 are set forth for controlling the power delivered to the bulbs. Each pixel 10 has four incandescent bulbs 70, which in the preferred embodiment are xenon bulbs rated at five watts at 13.8 volts. It is to be understood that a colored pixel requires only three colors: red, green, and blue. Hence, under the teachings of the present invention, a pixel would have at least three lamps. Xenon bulbs are inexpensive and long lived. With four bulbs used per pixel, this amounts to about 20 watts, which is far less than conventional incandescent displays, but greater than conventional LED displays.

Bulbs 70 are connected to an alternating current power source, VAC, and are further interconnected over lines 80 to the TRIACS 60. Line 80*a* is connected from green bulb 70*a* to TRIAC 90*a*. The power input to TRIAC 90*a* is connected to an alternating current, low voltage source through ground, and the control input to TRIAC 90*a* is connected through resistor 100*a* to line 110*a*. A phase-delayed gate signal is applied to line 110*a*, and the TRIAC 90*a* then turns on, powering the green bulb 70*a*. The remaining blue, green, and red bulbs are interconnected in an identical arrangement. As can be observed, for a given pixel 10, four input lines 110 control four TRIACs 90 for controlling the color of the pixel. For example, for pixel 10*a*, green is controlled by a signal on-line 110*a*, red is controlled by a signal on line 110*b*, and blue is controlled by signals on lines 110*c* and 110*d*. It is possible to have $256^4$ color combinations in this design. However, as mentioned, the same power level is delivered to both blue bulbs 70*c* and 70*d*, resulting in $256^3$ color combinations.

Figure 4:
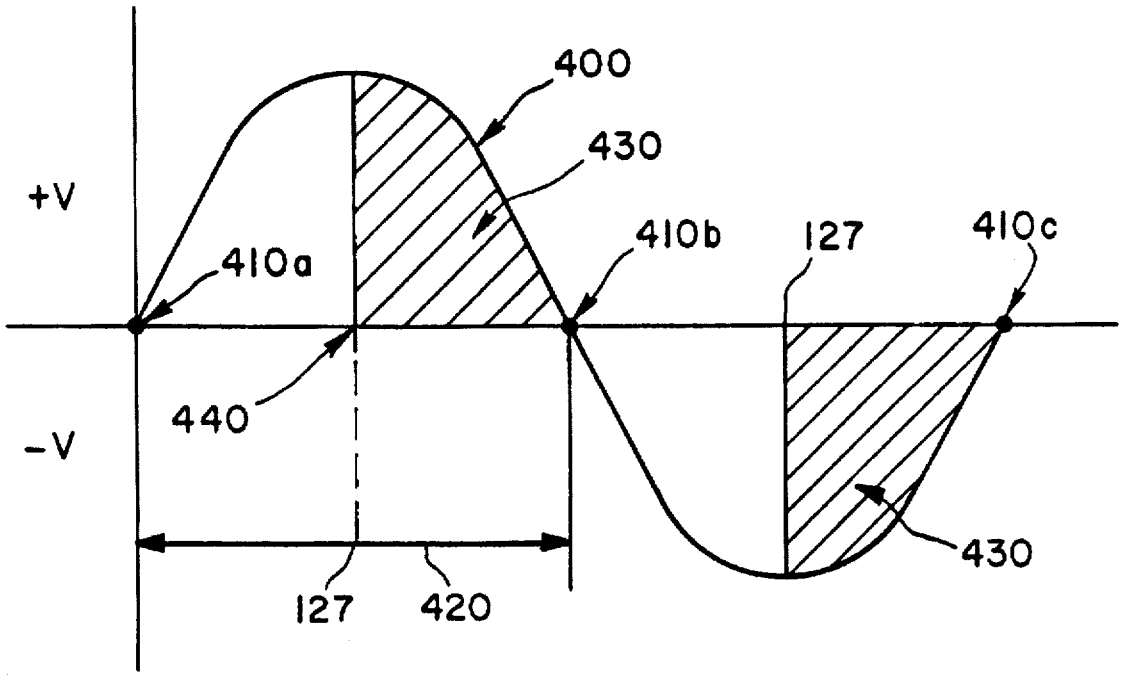
FIG. 4 graphically illustrates the delivery of phase-delayed power to an incandescent bulb.

In FIG. 4, the operation of a TRIAC 90 in conjunction with a bulb is set forth. In FIG. 4 the alternating current voltage source is delivered on line 110 to each TRIAC 90. The voltage curve 400 is shown for a single cycle. There are three zero-crossing points 410 shown. Under the teachings of the present invention, between each set of zero-crossing points (for example 410*a* and 410*b*), 256 phase triggering positions 420 exist. These triggering positions 420 are evenly spaced between 0 and 180 degrees. Assume the power delivered to the bulb 70 is desired to be at 50%. As shown in FIG. 4, the TRIAC 90 is turned on at step 127 (midway between 0 and 256) so that the phase-delayed power shown by the shaded portion 430 is delivered to the bulb 70. The signal on line 110 is a phase trigger signal designed to trigger between the zero-crossing points. It can be easily observed that each bulb 70 (or in the case of blue the two connected bulbs) can have its intensity varied at 256 separate levels fully dependent on the phase-delayed power 430 delivered to the bulb 70. The level 0 corresponds to no light intensity in a bulb and the level 255 corresponds to full light intensity.

In operation, once the TRIAC 90 is triggered by a signal on line 100*a* it stays on until the zero-crossing (for example 410*b*) occurs at which time it is turned off. This is a characteristic of TRIACs. The TRIAC remains turned off until the next trigger at count 127, whereupon it stays turned on until the next zero-crossing (for example 410*c*). For purposes of terminology any circuit controlling the phase-delayed power of FIG. 4, including but not limited to a TRIAC, shall be called an AC phase switch.

Figure 5:
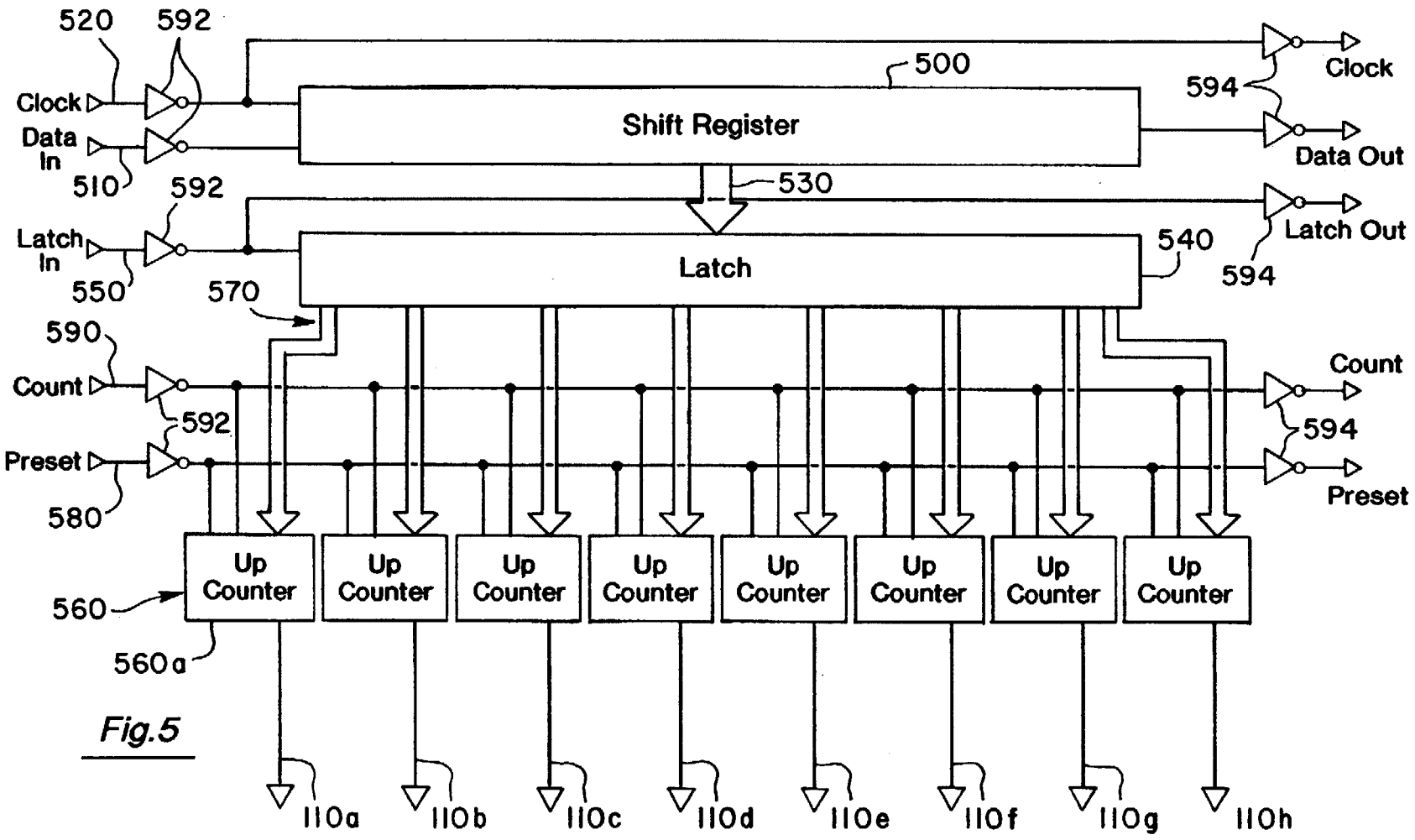
FIG. 5 is a block diagram setting forth the components of the dual pixel phase-delayed power control of the present invention.

In FIG. 5, the application specific integrated circuit (ASIC) of the present invention for controlling the TRIACs 90 is shown. This chip resides on the module 50 of the display and controls two pixels.

In the preferred embodiment, a shift register 500 is utilized to receive data serially shifted in at high speeds on line 510. The shifting occurs through use of clock pulses on line 520. In this design, 64 bits are shifted into the shift register 500. Once complete, the 64 data bits are delivered over a parallel connection 530 to a latch 540. Latching occurs by means of a latch-in signal on line 550. The data is latched and continually controls the power delivered to the bulbs until new data is latched in.

The 64-bit latch 540 is interconnected with a series of up counters 560. Each up counter contains a byte (8 data bits). Hence, there are eight up counters 560. The data in the 64-bit latch 540 is delivered over lines 570 into the up counters 560. This is a parallel transfer. The value of the byte of information is loaded into each up counter 560 from the latch 540 with a preset signal appearing on line 580. Once the byte of information has been loaded into each up counter 560, the count pulse on line 590 is utilized to count upwardly from the data value stored in the up counter 560.

By way of illustration and with reference back to FIG. 4, assume that bulb 70*a* is desired to be illuminated at 50% intensity. The data value loaded into up counter 560*a* equals 127. The value of 127 is loaded into the up counter 560*a* at zero-crossing point 410*a*. The count pulses on line 590 commence to count up from 127 to 255. They reach 255 at the 50% power point 440, thereby causing an output on line 110 to turn on the TRIAC 90*a*, which remains on to deliver 50% power 430 in FIG. 4 to the bulb 70*a* until it is turned off at zero-crossing point 410*b*. If it is desired, for example, to have full intensity, then a value of 255 would be loaded into the up counter 560*a* so that a signal immediately appears on line 110*a* to deliver full power to the bulb 70*a* (i.e., the count reaches the full count without being incremented). If no power is desired, then a count of zero would be loaded into up counter 560*a* and the up counter would count 255 pulses to provide a signal just before the zero-crossing 410*b*. Hence no power would be delivered to the bulb 70*a*. It is to be understood that a down counter could also be used wherein the preset value is decremented to zero. In essence, the preset value in the counter is changed until a preselected value is reached (i.e., either 255 or 0).

In summary, a high-speed control for delivering preset phase-delayed power from an AC power source to an incandescent bulb has been disclosed in FIG. 5.

3. Processor-FIFO Interface Architecture

Figure 6:
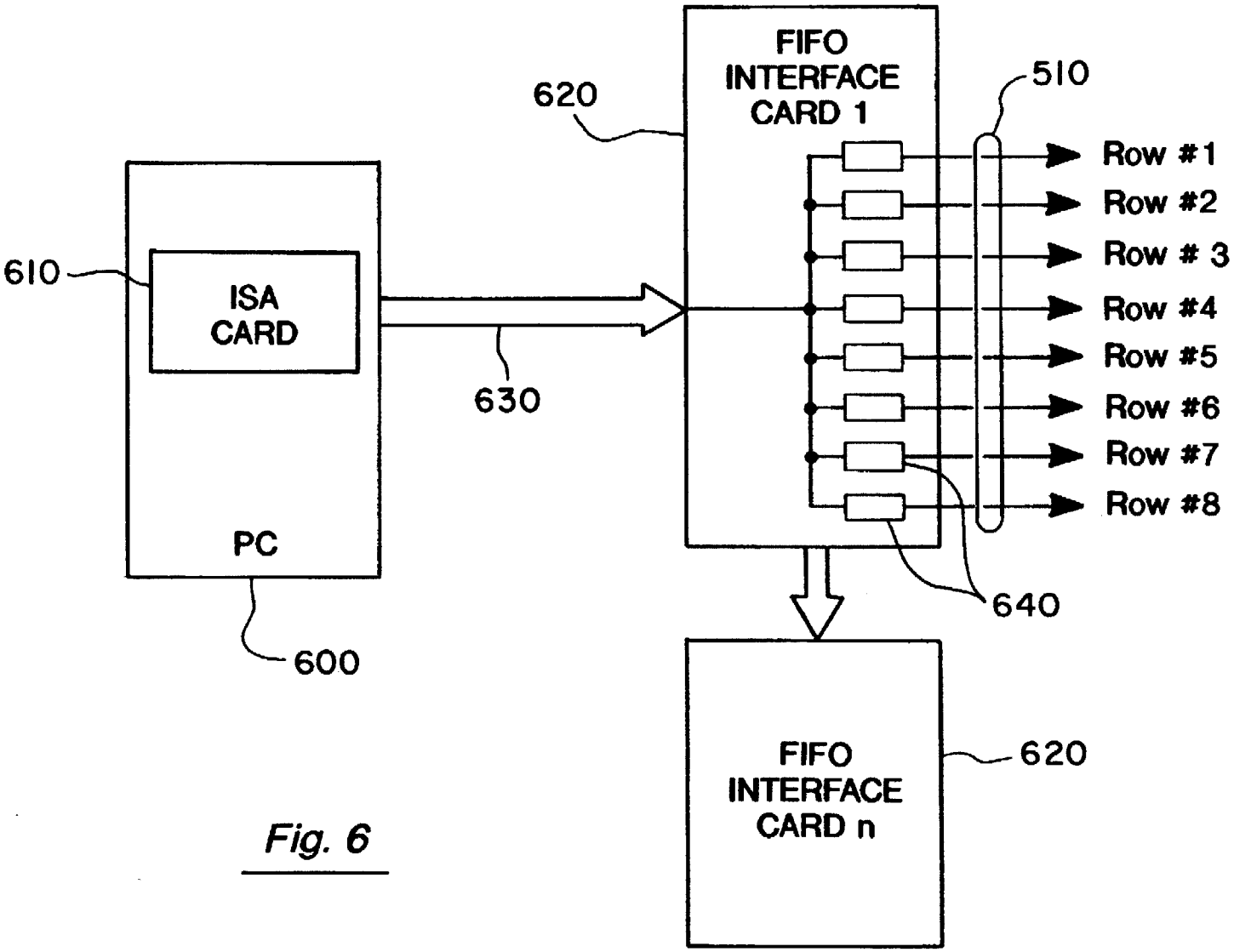
FIG. 6 is a block diagram setting forth the components of the processor and interface cards of the present invention.

In FIG. 6, the processor and interface architecture for the TRIAC control of FIG. 5 is set forth. A conventional computer such as an IBM-compatible PC 600 contains an industry standard architecture (ISA) bus card 610. The bus card 610 is designed to write data at the NTSC rate of 30 frames per second to a number of FIFO cards 620 (FIFO 1–FIFO N). The data is written over interface bus 630, which in the preferred embodiment is a 16-bit parallel data bus. All of the FIFO interface cards 620 can be fully refreshed in under 15 milliseconds. The FIFO interface cards 620 are designed to accept 16-bit parallel data from the PC 600 over the bus 630. In the preferred embodiment, each card 620 is designed to have eight FIFO memories 640. Each FIFO memory 640 continually accepts the 16-bit parallel data from the computer 600 until all FIFO memories 640 are filled. When the memories are filled, the data is read out over serial lines 510 to the interconnected pixel rows at a 7.3 MHz rate.

Figure 7:
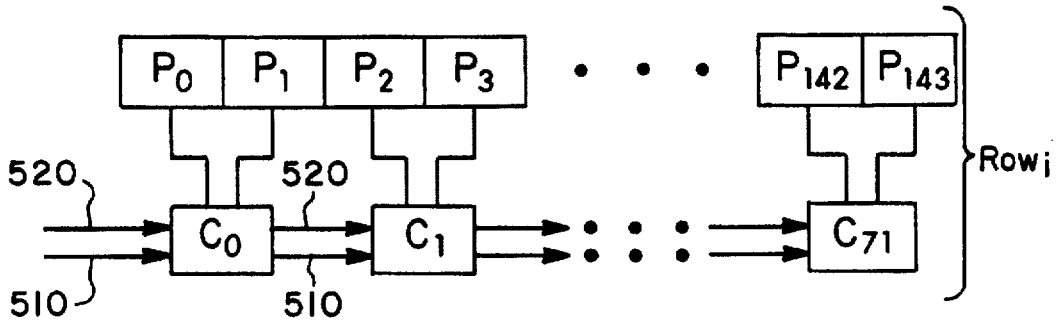
FIG. 7 shows the cascading of phase-delayed power controls together in a row of pixels.

This is best explained by reference to FIG. 7 and by way of example. Assume that a display is 144 pixels wide. One row of 144 pixels would require 36 modules 50 (FIG. 2) arranged horizontally. This is shown in FIG. 7 ($P_0$–$P_{143}$). The controller of FIG. 5 is shown interconnected and controlling the pixel P (for example, $C_0$ controls pixel $P_0$ and pixel $P_1$). The controls C are interconnected in daisy chain fashion such that the data appearing on lines 510 is interconnected from one control to the next control. Likewise, the clock signal 520 is daisy chained from control to control. Each control C requires 64 bits of data. Hence, for 72 controls, $C_1$–$C_{71}$, 576 bytes of data in length are required. When the registers 500 are loaded, each byte based on its position in the pixel row controls the intensity of one lamp. This approach does not require individual addressing of the lamps or pixels in a row. When the shift register 500 is loaded, the data byte positions are directly wired to the latch 540. Hence, in FIG. 6 each individual FIFO 640, in this example, is filled with 576 bytes of data. When the interface card 620 has been completely filled, the data is released to the pixel rows.

The display can be of any height. For example, if the display has 128 pixel rows, then 16 interface cards 620 (each having 8 rows) would be utilized. Each FIFO interface card 620 and each FIFO is separately addressable by the computer 600. This is the only aspect of the present invention that is addressable. There is no requirement to address individual pixels P within a row. Each pixel row has the data bytes arrayed to specifically align with the number of horizontal pixels. The interface card 620 is designed to contain a known number of rows so that the delivery of the data over the bus 630 into the card 620 is simply a predetermined mapping of data bytes to a known number of rows having a known number of pixels. This provides a simplified design having the capabilities of great speed and updating the intensities of each pixel. Any suitable size of display can easily be designed under the teachings of the present invention.

4. Operation

Figure 8:
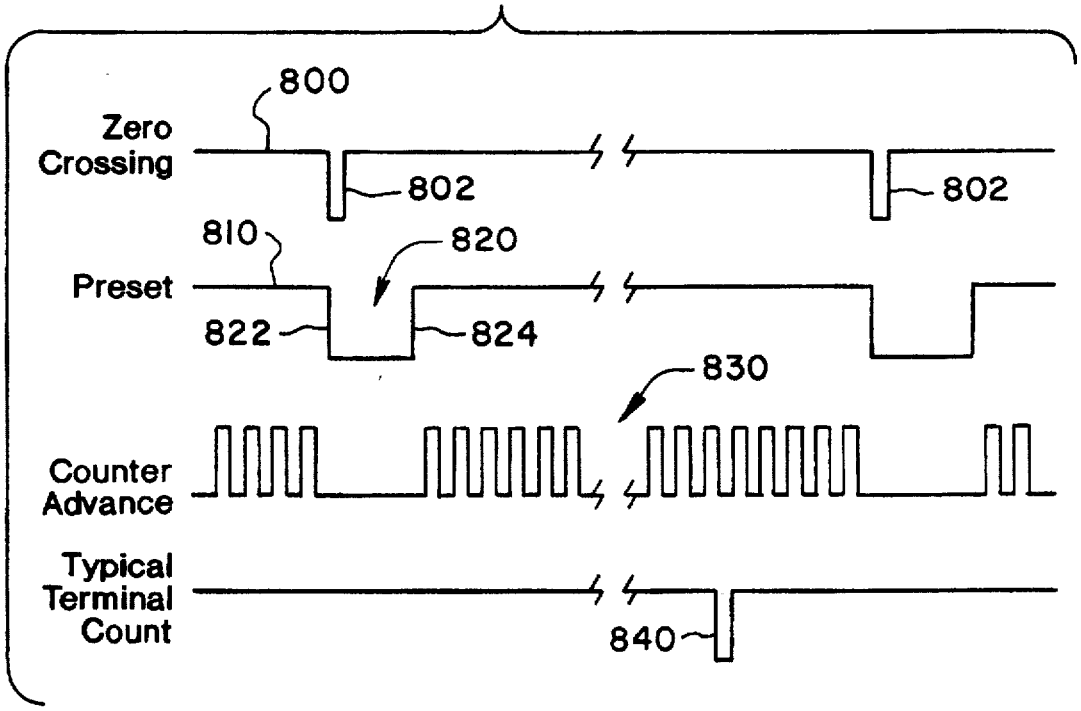
FIG. 8 sets forth the timing relationship in a phase-delayed power control.

The operation of the TRIAC control shown in FIG. 5 is set forth in FIG. 8. In FIG. 8, the zero-crossings 410 (FIG. 4) are detected. Circuitry for detecting zero-crossings 410 is well known in the art. The zero-crossing pulses 802 are shown in wave form 800. The preset pulses 810 are presented on line 580 of FIG. 5 and are in synchronization with the zero-crossing pulses 800. The edge 822 is used to gate-in the eight data bit value over bus 570 into the up counter 560. The pulse 820 presets the up counter so that upon the occurrence of edge 824 the count pulses 830 on line 590 are used to increment the counter 560. These count pulses 830 are continuous until the next zero-crossing 800. When the count equals the predetermined value of 255 (in the preferred embodiment), a trigger signal 840 is issued on line 110. It is to be understood that the pulses 830 are not to scale and serve to illustrate the present invention. The zero-crossing pulses 802 for 60 Hz AC occur 120 times per second. Hence, the preset pulses occur 120 times per second and are in synchronism with the zero-crossing pulses 802. The counter advance pulses 830 appearing on line 590 are also in synchronism with the zero-crossing pulses 802 and deliver count pulses 830 at a frequency of about 40 KHz or pulses every 25 microseconds.

In AC powered environments, three phase (A, B, and C) power is available. The first interface card 620 and its associated pixel rows may operate on phase A and sense the zero-crossings for that phase. The second card may operate on phase B, the third on phase C, the fourth on phase A, etc. With the TRIACs 90 updating bulbs 70 120 times per second, the present invention is capable of displaying images at the NTSC standard of 30 frames per second.

5. FIFO Interface Card

Figure 9:
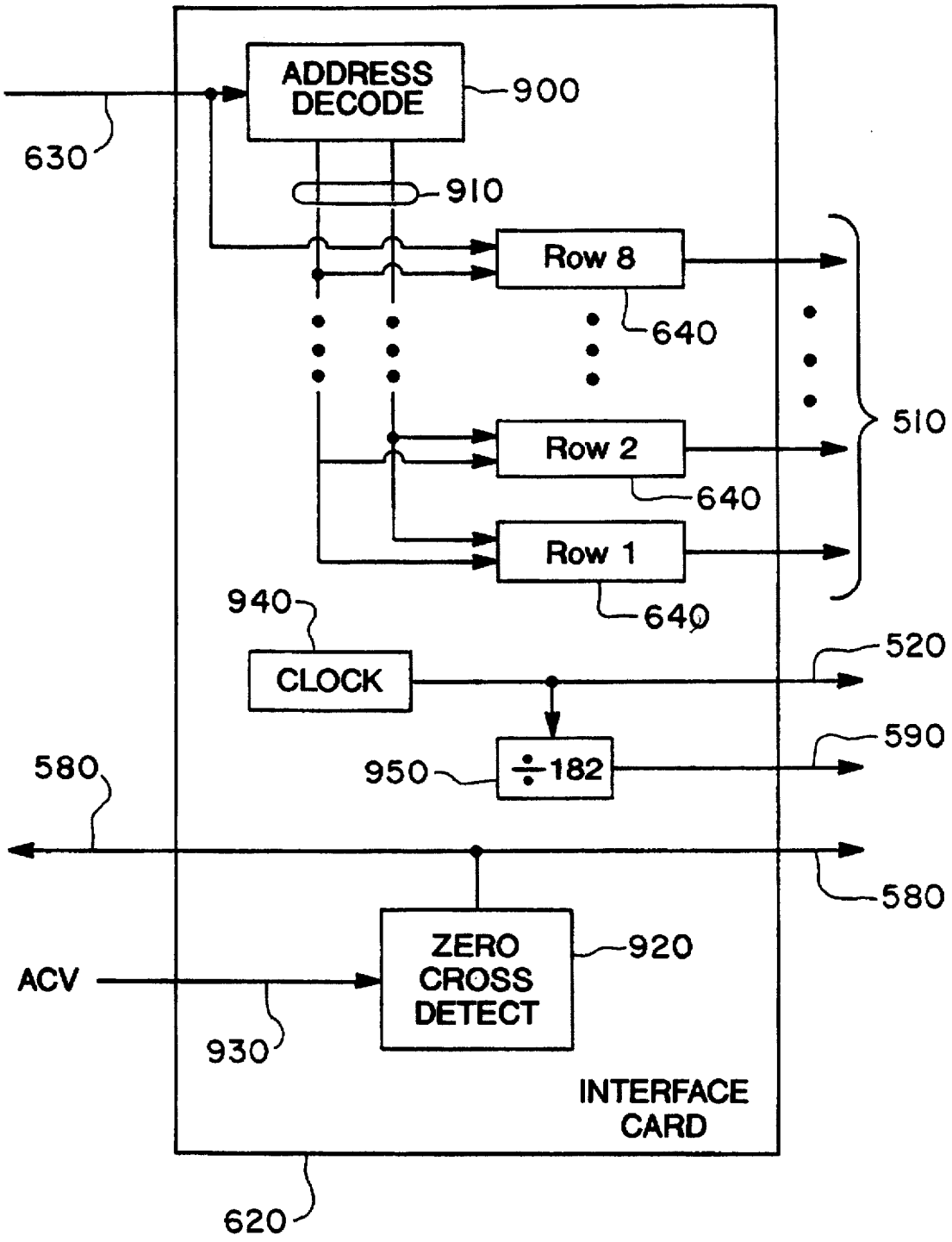
FIG. 9 sets forth the block diagram of the FIFO interface card of the present invention.

In FIG. 9, the details of an interface card 620 are set forth. As mentioned, each pixel row of the display has its own FIFO 640. The preferred embodiment has eight pixel rows of FIFOs 640 on a card 620. The output 510 for each FIFO 640 is the data-in line 510 in FIG. 5. Each FIFO 640 contains the required number of data bytes to be equal to the number of pixel lamps in one row of the sign. Hence, if a row in the sign has 144 pixels, then at 4 bytes per pixel (1 byte per up counter 560), the FIFO 640 is 576 data bytes wide.

Hence, when the address of a given FIFO interface card 620 is detected in the address decode circuit 900, the ensuing data delivered on bus 630 is delivered to the Row 1 FIFO 640, then to the row 2 FIFO 640, etc., until the FIFO 640 for the last row is filled. The address decode circuit 900 issues an enable over line 910 enabling each FIFO 640 to be addressed and to receive data. The Row 1 FIFO is filled first and each FIFO is then filled sequentially until the last row FIFO is filled. When the entire set of FIFOs for an interface card 620 is filled, a new address appears on bus 630 for another FIFO interface card 620. The interface card 620 then proceeds to download in serial fashion from the FIFOs for each row simultaneously to their respective rows in the display. This occurs only when the last FIFO (i.e., row eight in FIG. 9) is completely filled.

The interface card 620 has a zero-crossing detect circuit 920 that is interconnected to the AC voltage source over line 930. This conventionally detects zero-crossings and delivers the pulse 840 appearing on line 580 to the up counters 560. The zero-crossing signal on line 580 may also be delivered back to the computer 600 for timing purposes.

Located on the interface card 620 is a clock 940 that in the preferred embodiment is a 7.3 MHz clock, although any suitable clock source greater than 6 MHz could be used under the teachings of the present invention. The clock pulses at 7.3 MHz are delivered over lines 520 as pulses 800.

In this fashion, the necessary data bytes stored in the FIFO 640 are serially delivered into all of the interconnected 64-bit shift registers 500 for the entire pixel row. After full delivery for the row has taken place, the latch-in signal on line 550 latches all of the data from the shift register into the 64-bit latch 540. All data bytes in the FIFOs for Rows 1–8 are delivered simultaneously and not sequentially. In this fashion, eight rows of pixels in the display are updated simultaneously. The interface card 620 is then ready to receive new data from the computer 600 over bus 630. It is be observed that no addressing of a pixel is required.

6. Vivid Colors

FIG. 10 sets forth another aspect of the present invention pertaining to the selection of level for the phase-delayed power. In the preferred embodiment, the following levels are used:

| | |
|---|---|
| Red | 32 levels |
| Green | 64 levels |
| Blue | 32 levels |

As set forth above, each incandescent bulb 70 can have 256 levels of intensity. However, 32 gray levels are used for red and for blue and 64 gray levels are used for green. Hence, a total of 65,536 (32×32×64) colors are achieved in the preferred embodiment. This is an optional feature of the present invention since the present invention is capable of 256 gray levels at each bulb 700. However, the above levels are selected to provide a true color display with vivid colors. It is to be kept in mind that the blue color as shown in FIG. 1 has twice the spatial area of red and green.

Xenon incandescent bulbs, as is true of all incandescent bulbs having filaments, have characteristic light outputs. The goal of the present invention in this optional embodiment is to match the incoming image gray level data to a desired phase level delivered into the up counter 560. The goal is to have discrete phase-delayed power levels that provide a linear color intensity output from each colored pixel. Under the teachings of the present invention, this is determined empirically by using a light meter to measure the light intensity from the xenon bulb for each of the 256 delayed power phase data values.

The linearization of light levels occurs as follows. The actual light output characteristics of a phase-controlled lamp do not vary linearly with time delay or phase shift delay. To compensate for this non-linearity, only those values from the set of 256 values established by an actual plot of the lamp characteristics that most closely match the desired linear light level (one of 32 or 64 levels), where the maximum level is a percentage of the actual maximum light available, are chosen. The percentage of maximum is established by either brilliance selection or hue adjustment or both.

The invention has been described with reference to the preferred embodiment. Modifications and alterations will occur to others upon a reading and understanding of this specification. It is intended to include all such modifications and alterations insofar as they come within the scope of the appended claims or the equivalents thereof.

I claim:

1. A high-speed control for delivering phase-delayed power to an incandescent bulb at one of a predetermined number of levels, said high speed control comprising:

an AC power source for providing AC power, an AC phase switch connected to said incandescent bulb and to said AC power source, a counter connected to said AC phase switch, a register connected to said counter, means for inputting into said register a delayed phase power level, said delayed phase power level corresponding to said one predetermined level, a phase signal in synchronism with the zero-crossings of said AC power for gating said delayed phase power level from said register into said counter each half cycle of said AC power, and clock pulses in synchronism with said phase signal for incrementally changing the delayed phase power level during each said half cycle in said counter until a pre-selected value is reached wherein said clock pulses in said half cycle equal said predetermined number, said counter upon reaching said pre-selected value issuing a signal to activate said AC phase switch so as to provide said phase-delayed power at said one predetermined level to said incandescent bulb during each said half cycle.

2. The high-speed control of claim 1 wherein said AC power source is 60 Hz.

3. The high-speed control of claim 1 wherein said incandescent bulb is a xenon lamp.

4. The high-speed control of claim 1 wherein said phase switch is a TRIAC device.

5. The high-speed control of claim 1 wherein said register is a latch register.

6. The high-speed control of claim 1 wherein said inputting means comprises a serial shift register.

7. The high-speed control of claim 1 wherein said counter is an up counter, said predetermined number of levels is 256, and said preselected value is 255.

8. A high-speed control for delivering phase-delayed power to each of at least three incandescent bulbs, each of said at least three incandescent bulbs oriented behind a colored lens to form a colored pixel, said colored pixel being illuminated to a color by said high-speed control, said high-speed control comprising:

an AC power source having cycles of AC power with zero-crossings, an AC phase switch control connected to each of said at least three incandescent bulbs and to said AC power source, each said AC phase switch control comprising:

(a) an AC phase switch, (b) a counter connected to said AC phase switch, (c) a register connected to said counter, means connected to said AC phase switch control for inputting into each said register in each of said AC phase switch controls a power phase level, each said power phase level corresponding to a light intensity for said connected incandescent bulb, a phase signal in synchronism with the zero-crossings of said AC power for gating each said power phase level from each said register into each said counter during each half cycle of said AC power, and clock pulses in synchronism with said phase signal for changing each said power phase level in each said counter until a pre-selected value is reached wherein said clock pulses in said half cycle equal said predetermined number, each said counter upon reaching said pre-selected value issuing a signal to activate each said AC phase switch so as to provide said phase-delayed power to each of said at least three incandescent bulbs.

9. The high-speed control of claim 8 wherein said at least three incandescent bulbs comprise a pixel.

10. The high-speed control of claim 9 wherein said colored lenses comprise: a red lens, a green lens, and two blue lenses, said two blue lenses being of the same tint.

11. The high-speed control of claim 9 wherein the two xenon bulbs behind said two blue lenses have the same phase-delayed power.

12. The high speed control of claim 9 wherein the two xenon bulbs behind said two blue lenses have the same power.

13. The high-speed control of claim 8 further comprising means connected to said inputting means for delivering said power phase levels into said inputting means at a frequency greater than 6 Mhz.

14. A high-speed control for delivering phase delayed power to each of four incandescent bulbs, each of said four incandescent bulbs oriented behind a colored lens to form a colored pixel, said colored pixel being illuminated to a color by said high speed control, said high speed control comprising:

an AC power source having sixty cycles of AC power with zero-crossings, an AC phase switch control connected to each of said incandescent bulbs and to said AC power source, each said AC phase control comprising:

(a) a TRIAC (b) an up counter connected to said AC phase switch, (c) a latch register connected to said up counter, a serial shift register receiving power phase level data at a frequency of at least 6 Mhz for inputting into each said register in each of said AC phase controls a power phase level, each aforesaid said power phase level corresponding to a light intensity for said connected incandescent bulb, a phase signal in synchronism with the zero-crossings of said AC power for gating each said power phase level from each said latch register into each said counter during each half cycle of said AC power, clock pulses in synchronism with said phase signal for changing each said power phase level in each said up counter until a pre-selected value is reached said pre-selected value being in the range between 0 and 255, wherein said clock pulses in said half cycle equal said predetermined number and wherein 0 corresponds to no intensity and 255 corresponds to full intensity, each said counter upon reaching said pre-selected value issuing a signal to activate each said TRIAC switch so as to provide said phase delayed power to each of said four incandescent bulbs.

15. The high speed control of claim 14 wherein said colored lenses comprise: a red lens, a green lens, and two blue lenses, said two blue lens being of the same tint.

* * * * *